US005207188A

United States Patent [19]

Hama et al.

[11] Patent Number: 5,207,188

[45] Date of Patent: May 4, 1993

[54] CYLINDER FOR MULTI-CYLINDER TYPE ENGINE

[75] Inventors: Fujio Hama; Kenichi Harashina, both of Nagano, Japan

[73] Assignee: Teikoku Piston Ring Co., Ltd., Tokyo, Japan

[21] Appl. No.: 799,532

[22] Filed: Nov. 27, 1991

[30] Foreign Application Priority Data

Nov. 29, 1990 [JP] Japan ..... 2-332337

[51] Int. Cl.[5] ..... F02F 1/14

[52] U.S. Cl. ..... 123/41.79; 123/41.74

[58] Field of Search ..... 123/41.74, 41.79, 41.8, 123/41.84

[56] References Cited

U.S. PATENT DOCUMENTS 2,810,378 10/1957 Burch ..... 123/41.74

FOREIGN PATENT DOCUMENTS 0356227 2/1990 European Pat. Off. .
928901 6/1947 France .
299030 12/1928 United Kingdom .
294648 4/1929 United Kingdom .
900294 7/1962 United Kingdom .

*Primary Examiner*—Noah P. Kamen
*Attorney, Agent, or Firm*—Hill, Steadman & Simpson

[57] ABSTRACT

Each of a plurality of cylinder liners has a cooling liquid groove at its outer circumferential surface and has a flat surface over an entire axial length at a part of the outer circumferential surface. The cylinder liners are inserted in bores of a cylinder block with flat surfaces of adjacent liners abutting each other and the grooves at the flat surfaces being coincident with each other.

8 Claims, 3 Drawing Sheets

CYLINDER FOR MULTI-CYLINDER TYPE ENGINE

BACKGROUND OF THE INVENTION

1. Field of the Invention

This invention relates to a cylinder for a multi-cylinder type engine, and more particularly a cylinder of which cooling is carried out by flowing cooling liquid in grooves formed at the outer circumferential surfaces of cylinder liners inserted into a cylinder block.

2. Description of the Related Art

It is known in the prior art to provide a cylinder for a multi-cylinder type engine in which an outer circumferential surface of each of the cylinder liners is formed with a cooling liquid groove, the cylinder liner is fitted into a bore part of a cylinder block, a space defined between an inner circumferential surface of the bore part in the cylinder block and the cooling liquid groove forms a cooling liquid flow passage, cooling liquid is flowed at a high speed in the cooling liquid flow passage so as to cool the cylinder liner.

With the foregoing arrangement, the cylinder block is provided with a plurality of spaced-apart bores through which the cylinder liners are inserted, and an inter-bore pitch is larger than an outer diameter of each of the cylinder liners.

SUMMARY OF THE INVENTION

In recent years, an engine has been required to have a smallsized and light weight unit. The present invention may respond to this requirement. That is, it is an object of the present invention to provide a cylinder for a multi-cylinder type engine in which an inter-bore pitch (a pitch between the cylinder liners) can be made smaller than an outer diameter of the cylinder liner and the cylinder block can be made smaller in size and lighter in weight.

The cylinder for a multi-cylinder type engine of the present invention is comprised of a plurality of cylinder liners, each having a cooling liquid groove at an outer circumferential surface and having a flat surface at a part of the outer circumferential surface and a cylinder block having bores into which said plurality of cylinder liners are inserted, wherein said plurality of cylinder liners are arranged with said flat surfaces abutted to each other, arranged such that the cooling liquid grooves at said flat surfaces are coincided to each other and then the cylinder liners are inserted into the bores of the cylinder block.

As the cooling liquid groove, the groove comprising a plurality of annular grooves and axial grooves to cause said annular grooves to be communicated or helical groove or the like is applied.

Since a part of the outer circumferential surface of the cylinder liner forms a flat surface and the adjoining cylinder liners are arranged with their flat surfaces abutted to each other, a pitch between the cylinder liners can be made smaller than an outer diameter of the cylinder liner. Due to this fact, the cylinder block can be made smaller in size and lighter in weight, resulting in that the engine can be made smaller in size and lighter in weight.

In addition, the cooling liquid flowing in the cooling liquid groove formed in a circumferential direction shows a fast flow speed at the portion of the flat surface due to the fact that a sectional area of the groove at the flat surface is reduced. Accordingly, since a coefficient of heat-transfer of the cooling liquid at that location is increased, the adjoining locations of the cylinder liners are cooled more than that of other circumferential locations. Due to this fact, the circumferential location in the cylinder liner where an efficiency of thermal dispersion of the cylinder block is poor is cooled more, resulting in that it may contribute to a uniform formation of the temperature in the circumferential directions of the cylinder liner.

DESCRIPTION OF THE PREFERRED EMBODIMENTS

Figure 1:
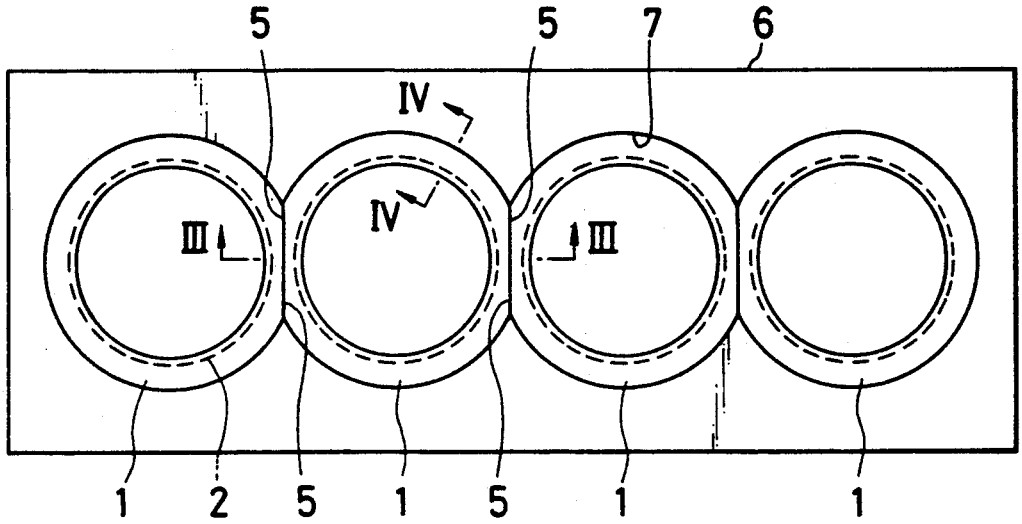
FIG. 1 is a top plan view for showing a cylinder block into which cylinder liners of the present invention are fitted.
Figure 2:
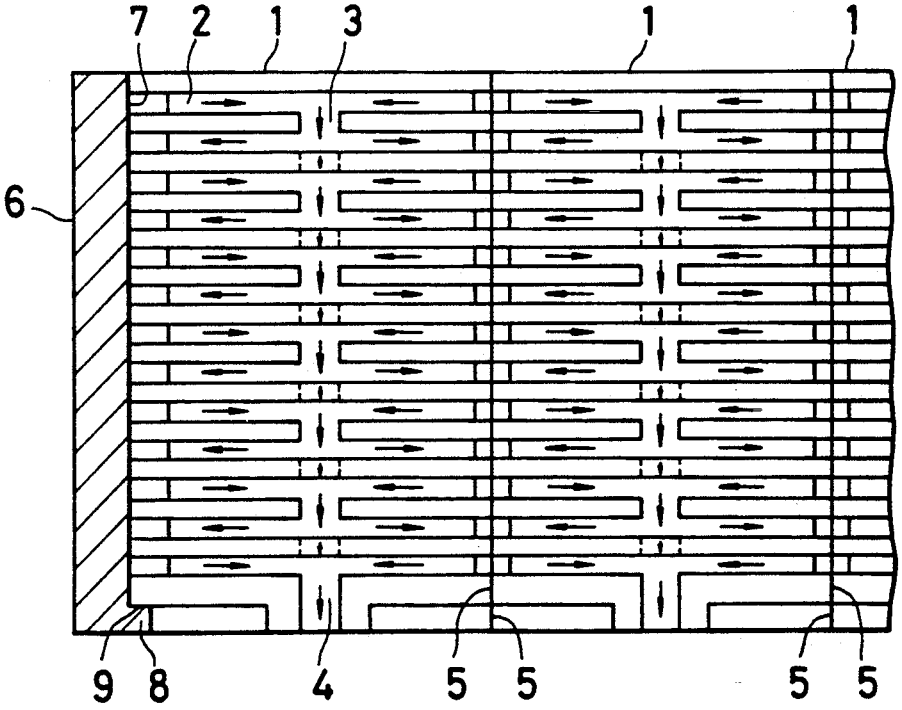
FIG. 2 is a longitudinal section for showing a part of FIG. 1.
Figure 3:
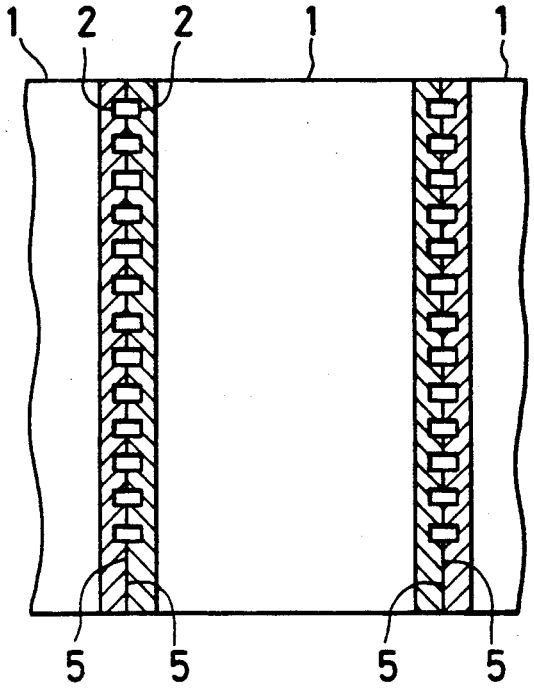
FIG. 3 is a sectional view taken along the line III—III of FIG. 1.
Figure 4:
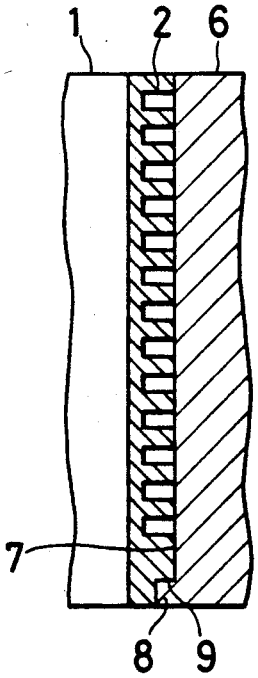
FIG. 4 is a sectional view taken along the line IV—IV of FIG. 1.

The above and other objects and features of the present invention will be made more apparent in view of the detailed description and the accompanying drawings.

Referring now to the drawings, the cases in which the present invention is applied to a series-connected four-cylinder type engine will be described.

In FIGS. 1 to 4, each of the cylinder liners 1 is formed with cooling oil grooves at its outer circumferential surface. The cooling oil grooves are comprised of a plurality of annular grooves 2 formed in equal-spaced apart relation in an axial direction of the cylinder liner, a plurality of axial grooves 3 for communicating the adjoining annular grooves 2 to each other and an axial discharging groove 4 communicating with the lowermost annular groove 2. Said axial grooves are arranged as one in a circumferential direction and are alternately arranged along an axial direction at locations spaced apart by 180° in a circumferential direction. The aforesaid axial discharging groove 4 is arranged at position spaced apart by 180° in a circumferential direction with the axial groove 3 just above the axial discharging groove 4. A part of the outer circumferential surface of each of the cylinder liners 1 forms a flat surface 5 over an entire axial length of it, the adjoining cylinder liners 1 are arranged with the flat surfaces 5 abutted to each other and at the same time they are arranged with the annular grooves 2 at the flat surfaces 5 coincided to each other. That is, each of the cylinder liners 1 at both ends has one flat surface 5 at the circumferential position spaced apart from the axial grooves 3 and 4 as viewed in FIG. 1. Each of the cylinder liners 1 at intermediate positions has two flat surfaces 5 at the circumferential positions spaced apart from the axial grooves 3 and 4, and the two flat surfaces 5 are arranged at positions spaced apart by 180° in the circumferential direction. Then, the cylinder block 6 is provided with bores 7 to which four cylinder liners 1 abutted to each other are fitted. The four cylinder liners 1 abutted to each other are fitted into the bores 7, and the stepped parts 9 arranged at the circumferences of the lower ends of the cylinder liners 1 are mounted on the liner receiving portions 8 arranged to be projected at the inner circumferential sides at the lower ends of the bores 7. The aforesaid liner receiving portion 8 and the stepped part 9 are arranged at portions except the axial discharging groove 4. Accordingly, since a pitch between the cylinder liners 1 is smaller than an outer diameter of each of the cylinder liners 1, a size of the cylinder block 6 can be decreased and the engine can be made smaller in size and lighter in weight.

Then, the engine lubricant as cooling oil is flowed at a fast speed from an upper part toward a lower part in the cooling oil groove in the cylinder liner 1 so as to cool the cylinder liner and then the cooling oil is discharged from the axial discharging groove 4 into an oil pan not shown. In this case, although the cooling oil flows in sequence in the annular grooves 2 from an upper part to the lower part through the axial grooves 3, the cooling oil flowing in the annular grooves 2 shows a fast flow speed at the portion of the flat surface 5 due to a reduced sectional area of the groove at the flat surface 5 (refer to FIGS. 3 and 4). Accordingly, since a coefficient of heat-transfer of the cooling oil at that location is increased, the adjoining portions of the cylinder liners 1 are cooled more as compared with that of other circumferential locations. Due to this fact, the circumferential location in the cylinder liner where an efficiency of thermal dispersion of the cylinder block is poor is cooled more, with the result that the temperature in the circumferential direction in the cylinder liners 1 can be made uniform.

In addition, the cooling liquid groove which can be applied to the present invention is not limited to the foregoing grooves, but other grooves can be applied. For example, there is a helical groove or one disclosed in Japanese Utility Model Application No. 62-60967 previously filed by the present applicant, i.e. the cooling liquid groove has a plurality of annular grooves, these plurality of annular grooves are divided into a plurality of groups of annular grooves, each of said groups of annular grooves has two axial grooves to cause said annular grooves to be communicated to each other and forming an outlet and an inlet for the cooling liquid, and said adjoining groups of annular grooves are communicated in series to each other by an outlet and an inlet for the cooling liquid.

Figure 5:
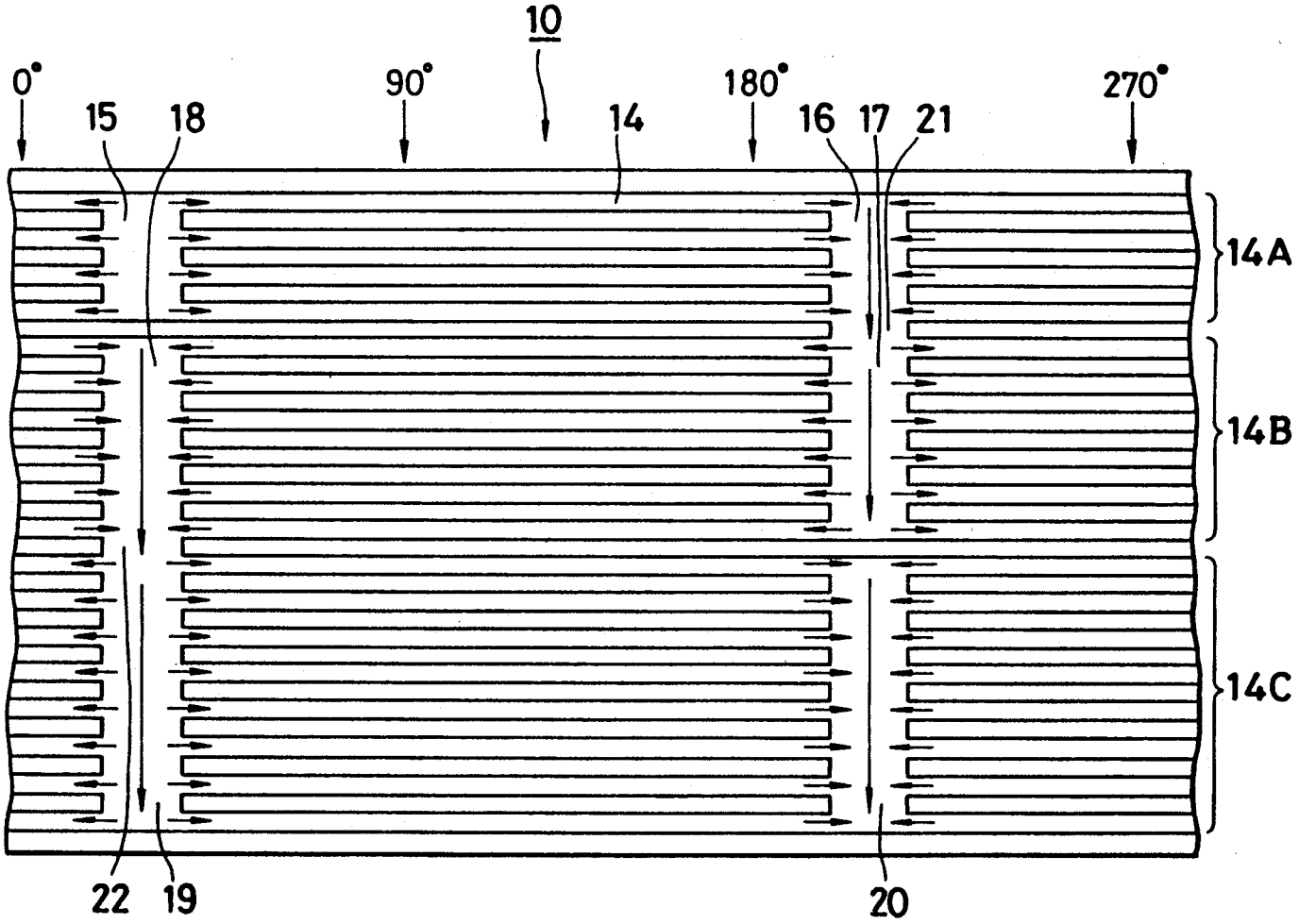
FIG. 5 is a development for showing a part of the outer circumferential surface of the cylinder liner so as to illustrate another example of the cooling liquid groove of the present invention.

An example of the cooling liquid groove will be described in reference to FIG. 5. An outer circumferential surface of the cylinder liner 10 is formed with eighteen annular grooves 14 spaced apart in an axial direction. These annular grooves 14 can be divided into three groups of annular grooves.

The three groups of annular grooves are the first group 14A of annular grooves ranging from the first annular groove 14 at the upper end of the cylinder liner to the fourth annular groove 14, the second group 14B of annular grooves ranging from the fifth annular groove 14 to the tenth annular groove 14 and the third group 14C of annular grooves ranging from the eleventh annular groove 14 to the last eighteenth annular groove 14.

In the first group 14A of annular grooves, two axial grooves 15 and 16 to cause the annular grooves 14 to be communicated to each other are provided at two positions spaced apart by 180° in a circumferential direction of the cylinder liner 10, in which one axial groove 15 forms a cooling liquid inlet and the other axial groove 16 forms a cooling liquid outlet. Similarly, in the second group 14B of annular groove, two axial grooves 17 and 18 to cause the annular grooves 14 to be communicated to each other are provided at the same two positions in the circumferential direction as the axial grooves 15 and 16 of the first group 14A of annular grooves, in which the axial groove 17 located at the cooling liquid outlet side of the first group 14A of annular grooves forms a cooling liquid inlet and the other axial groove 18 forms a cooling liquid outlet. Also in the third group 14C of annular grooves, two axial grooves 19 and 20 to cause the annular grooves 14 to be communicated to each other are provided at the same two positions in the circumferential direction as the axial grooves 17 and 18 of the second group 14B of annular grooves in their circumferential directions, in which the axial groove 19 located at the cooling liquid outlet side of the second group 14B of annular grooves forms a cooling liquid inlet and the other axial groove 20 forms a cooling liquid outlet.

The axial groove 16 forming the cooling liquid outlet of the first group 14A of annular grooves and the axial groove 17 forming the cooling liquid inlet of the second group 14B of annular grooves are communicated in series by the axial groove 21 which is located at the same circumferential location as those of said axial grooves 16 and 17 and is formed at the outer circumferential surface of the cylinder liner 10 between the fourth annular groove 14 and the fifth annular groove 14. In addition, similarly, the axial groove 18 forming the cooling liquid outlet of the second group 14B of annular grooves and the axial groove 19 forming the cooling liquid inlet of the third group 14C of annular grooves are communicated in series by the axial groove 22 which is located at the same circumferential location as those of said axial grooves 18 and 19 and is formed at the outer circumferential surface of the cylinder liner 10 between the tenth annular groove 14 and the eleventh annular groove 14.

Then, the aforesaid annular grooves 14 have a rectangular shape in section and all the sectional areas are the same to each other.

Flow of the cooling liquid will be described as follows. The cooling liquid flowed into the axial groove 15 forming the inlet of the first group 14A of annular grooves of the cylinder liner 10 flows to an opposite side in 180° in the annular grooves 14 of the first group 14A of annular grooves and then the cooling liquid flows from the axial groove 16 forming the outlet of the first group 14A of annular grooves into the axial groove 17 forming the inlet of the second group 14B of annular grooves. Then, the cooling liquid flows to an opposite side in 180° in the annular grooves 14 of the second group 14B of annular grooves and flows from the axial groove 18 forming the outlet of the second group 14B of annular grooves into the axial groove 19 forming the inlet of the third group 14C of annular grooves. The cooling liquid then flows to an opposite side in 180° in the annular grooves 14 of the third group 14C of annular grooves and further flows out of the axial groove 20 forming the outlet of the third group 14C of annular grooves into the passage arranged in the cylinder block. It is of course apparent that the discharging of the cooling liquid may be carried out by forming the discharging grooves in the cylinder liner in the same manner as that of the aforesaid preferred embodiment and discharging it into an oil pan.

In this case, the three groups 14A, 14B and 14C of annular grooves has a ratio of 2 : 3 : 4 in a total sectional areas of the annular grooves for the cooling liquid. A flow speed of the cooling liquid flowing in each of the groups 14A, 14B and 14C of annular grooves is as follows. A flow speed of the cooling liquid at the second group 14B of annular grooves is faster than that of the cooling liquid at the third group 14C of annular grooves, and a flow speed of the cooling liquid at the first group 14A of annular grooves is faster than that of the cooling liquid at the second group 14B of annular grooves.

Accordingly, the coefficient of heat-transfer of the cooling liquid is increased as it goes up to the upper part of the cylinder liner 10, resulting in that a cooling capability is increased from a lower part toward an upper part and an appropriate cooling corresponding to the temperature gradient in an axial direction of the cylinder liner is carried out. Also in the case of this cooling liquid groove, it is preferable that the flat surface to be formed at a partial circumferential outer surface of the cylinder liner is arranged at the circumferential position spaced apart from the axial groove in the same manner as that of the aforesaid preferred embodiment due to the fact that a uniform temperature can be attained in the circumferential direction.

Although in the aforesaid preferred embodiment, the sectional shape of the annular groove is a rectangular one, this is not limited to the rectangular one but it may be a V-shape, a semi-circular one and there is no specific limitation. However, in order to increase a thermal transfer area, a rectangular shape in the present preferred embodiment or a square shape is preferable.

In the aforesaid preferred embodiment, a plurality of annular grooves spaced-apart in an axial direction of the cylinder liner are divided into the three groups of annular grooves and a total sectional areas of the annular grooves for the cooling liquid in each of the groups of annular grooves is decreased from a lower part toward an upper part. However, it is also preferable that the annular grooves may be divided into two groups of annular grooves or more than three groups of annular grooves and then a total sectional areas of the annular grooves for the cooling liquid in each of the groups of annular grooves may be decreased from a lower part toward an upper part.

Although in the aforesaid preferred embodiment, a plurality of annular grooves are divided into a plurality of groups of annular grooves, it is also preferable that a plurality of annular grooves may be divided into one annular groove and a plurality of groups of annular grooves, said one annular groove is the first annular groove as counted from an upper end of the cylinder liner, each of said groups of annular grooves has two axial grooves to cause said annular grooves to be communicated to each other and forming an outlet and an inlet for the cooling liquid, said adjoining groups of annular grooves are communicated in series to each other by an outlet and an inlet for the cooling liquid, a total sectional areas of the annular grooves for the cooling liquid in each of said groups of annular grooves is decreased from a lower part toward an upper part in an axial direction of the cylinder liner, and said one annular groove is communicated with the inlet for the cooling liquid in said adjoining group of annular grooves.

It is of course that the cooling liquid is not limited to the cooling oil, but other cooling water or the like can be used.

Although the present invention invented by the present inventor has been described practically in reference to the preferred embodiments, it is apparent that the present invention is not limited to the aforesaid preferred embodiments, but various modifications can be attained without departing from its spirit and scope.

What is claimed is:

1. Cylinders for a multi-cylinder type engine comprising a plurality of cylinder liners, each liner having cooling liquid grooves at an outer circumferential surface and having a flat surface at a part of the outer circumferential surface, said cooling liquid grooves comprising a plurality of annular grooves and a plurality of axial grooves providing communication between the annular grooves, said axial grooves being arranged one by one between the adjoining annular grooves and alternately arranged along an axial direction at locations spaced apart by 180° in a circumferential direction, and a cylinder block having bores for receiving said plurality of cylinder lines, said plurality of cylinder liners being inserted into said bores and being arranged with said flat surfaces abutting each other, so that the cooling liquid grooves at said flat surfaces are coincident with each other.

2. Cylinders for a multi-cylinder engine comprising a plurality of cylinder liners, each liner having cooling liquid grooves at an outer circumferential surface and having a flat surface at a part of the outer circumferential surface, said cooling liquid grooves comprising a plurality of annular grooves, said plurality of annular grooves being divided into a plurality of groups of annular grooves axially spaced along the cylinder, each of said groups of annular grooves having two axial grooves providing communication between the annular grooves of the group and forming, respectively, an outlet and an inlet for a cooling liquid for the group, and an outlet of each group communicating in series with an inlet in an adjoining group of annular grooves, and a cylinder block having bores for receiving said plurality of cylinder liners, said plurality of cylinder liners being inserted into said bores and being arranged with said flat surfaces abutting each other, so that the cooling liquid grooves at said flat surfaces are coincident with each other.

3. Cylinders for a multi-cylinder type engine according to claim 2, wherein a total sectional area of the annular grooves in each group of annular grooves decreases from a lower part of each liner toward an upper part in an axial direction of the cylinder liner.

4. Cylinders for a multi-cylinder type engine according to claim 3, wherein an outer circumferential surface at a position above an uppermost group of annular grooves is provided with one annular groove communicating with the axial groove forming the inlet of said uppermost group of annular grooves.

5. A cylinder for a multi-cylinder type engine according to claim 2, wherein an outer circumferential surface at a position above an uppermost group of annular grooves is provided with one annular groove communicating with the axial groove forming the inlet of said uppermost group of annular grooves.

6. Cylinders for a multi-channel type engine according to claims 2, 3, 4 or 5, wherein the number of said groups of annular grooves is two ore more.

7. Cylinders for a multi-channel type engine according to claims 1, 2, 3, 4 or 5, wherein said flat surface is arranged at a circumferential position spaced apart from said axial grooves.

8. Cylinders for a multi-channel type engine according to claims 1, 2, 3, 4 or 5, wherein a sectional area of the annular groove at a location of said flat surface is smaller than that of the annular groove at other circumferential locations.

* * * * *